United States Patent [19]

Strunc

[11] 4,255,994

[45] Mar. 17, 1981

[54] PHOTOGRAPHIC PRINT SORTER WITH SENSOR TO DETECT PRESENCE OF PRINTS IN CONVEYOR LINES

[75] Inventor: Gerald R. Strunc, Maple Grove, Minn.

[73] Assignee: Pako Corporation, Minneapolis, Minn.

[21] Appl. No.: 122,434

[22] Filed: Feb. 19, 1980

[51] Int. Cl.[3] ..... B65H 35/06

[52] U.S. Cl. ..... 83/79; 83/89; 83/359; 83/364; 83/371

[58] Field of Search ..... 83/79, 89, 359, 364, 83/371, 365

[56] References Cited

U.S. PATENT DOCUMENTS

| | | | |
|---|---|---|---|
| 2,433,685 | 12/1947 | Dowell | 83/89 X |
| 3,272,044 | 9/1966 | Obenshain | 83/79 |
| 3,477,323 | 11/1969 | Osborn | 83/79 |
| 3,550,493 | 12/1970 | Benbenek | 83/79 X |
| 4,114,349 | 9/1978 | Jensen et al. | 53/54 |
| 4,128,887 | 12/1978 | Strunc et al. | 364/475 |

*Primary Examiner*—Frank T. Yost

*Attorney, Agent, or Firm*—Kinney, Lange, Braddock, Westman and Fairbairn

[57] ABSTRACT

A photographic print cutting and sorting apparatus cuts photographic prints from a continuous roll of processed photographic print paper and sorts the individual prints into good, remake and reject prints. The print sorter includes a main conveyor line or chute for good prints, a first branch conveyor line or chute for remake prints, and a second branch conveyor line or chute for reject prints. First and second diverters are provided for diverting the remake and reject prints into the first and second branch conveyor lines. The operation of the diverters is based upon remake and reject indicia marked on photographic prints and sensed by an indicia sensor. A print sensor located near the discharge ends of the main conveyor line and the first and second branch conveyor lines provides a signal when a trailing edge of a print passes the print sensor. A control circuit receives signals from the indicia sensor and the print sensor and controls the operation of the cutter and the first and second diverters. If the print being conveyed and sorted is a remake or reject print, the control circuit prevents the cutter from cutting another print until a signal is received from the print sensor for that print. If, on the other hand, the print being conveyed and sorted is a good print, the control circuit permits another print be cut prior to receiving a signal from the print sensor.

16 Claims, 3 Drawing Figures

PHOTOGRAPHIC PRINT SORTER WITH SENSOR TO DETECT PRESENCE OF PRINTS IN CONVEYOR LINES

BACKGROUND OF THE INVENTION

1. Field of the Invention

The present invention relates to photographic processing equipment. In particular, the present invention is a photographic print cutting and sorting apparatus.

2. Description of the Prior Art

In commercial photographic processing operations, very high rates of processing need to be achieved and maintained in order to operate profitably. To expedite the photographic processing, orders containing film of similar type and size are spliced together for developing. As many as 500 to 1000 rolls of 12, 20, 24 and 36 exposure film may be spliced together for processing and printing purposes.

After developing, the photographic film contained in the film negatives are printed in an edge-to-edge relationship on a continuous strip of photosensitive paper by a photographic printer. The photographic printer causes high intensity light to be passed through a negative and imaged on the photographic print paper. The photographic emulsion layer on the print paper is exposed and is subsequently processed to produce a print of the image contained in the negative.

After the strip of photographic print paper has been processed to produce prints, a photographic paper cutter cuts individual prints from the strip. The prints are then sorted by customer order, either manually or automatically, and ultimately packaged and sent to the customer.

Automatic print paper cutters have been developed which automatically cut the print paper into individual prints. These automatic paper cutters are controlled by indicia which are placed along the print paper by the photographic printer. Typically the indicia are of two types: cut marks and end-of-order marks. Cut marks indicate the desired location of a cut between adjacent prints. End-of-order marks, which typically appear along the opposite edge of the print paper from the cut marks, indicate the end of a customer's order. The automatic paper cutter includes a sensor which senses the cut marks and causes the individual prints to be cut from the strip at desired locations. The separated prints are passed to an order packaging or grouping device which groups the prints in response to the end-of-order marks which are sensed by the automatic cutter.

The desire for higher rates of processing within commercial photographic processing operations has led to the development of extremely high speed automatic paper cutters. One example of such an automatic paper cutter is the Pako PC305 print cutter manufactured by Pako Corporation, the assignee of the present application. A description of the Pako PC305 may be found in U.S. Pat. No. 4,128,887 by G. Strunc and F. Laciak. The Pako PC305 print cutter is capable of cutting over 25,000 prints per hour (i.e. over seven prints per second).

Photographic print sorting devices have also been developed for sorting individually cut photographic prints into "good," "remake," and "reject" prints. One successful form of photographic print sorting apparatus is the Pako PS305 print sorter manufactured by Pako Corporation, the assignee of the present application. A general description of this type of photographic print sorting apparatus may be found in a U.S. patent application by R. E. Diesch and C. L. Eutenuer entitled "PHOTOGRAPHIC PRINT STACKING DEVICE," Ser. No. 21,091 filed Mar. 16, 1979 and assigned to the same assignee as the present application. The PS305 print sorter is used in conjunction with the Pako PC305 paper cutter described above. The PC305/PS305 cutting and sorting apparatus is controlled by a common microprocessor housed within the PC305 paper cutter. A remake/reject indicia sensor mounted near the knife assembly of the PC305 cutter senses indicia on the prints which indicate the presence of a remake or reject print. The PS305 sorter has a main conveyor line for good prints, a first branch conveyor line for remake prints, and a second branch conveyor line for reject prints. A first diverter may be actuated to divert remake and reject prints from the main conveyor line into the first branch conveyor line. A second diverter may be actuated to divert reject prints from the first branch conveyor line into the second conveyor branch line. Operation of the first and second diverters is controlled by the microprocessor as a function of the signals from the remake/reject indicia sensor. Print stacking devices are positioned at the discharge end of the main conveyor line and the first branch conveyor line for stacking the good and remake prints, respectively. The reject prints are driven out the bottom of the apparatus into a waste container or the like.

Another successful automatic print sorting apparatus is the Pako Photopacker manufactured by Pako Corporation. The Pako Photopacker cuts, sorts, conveys, and packs photographic prints into a packaging envelope. In addition, the Pako Photopacker also cuts and packs photographic film negatives into the same packaging envelope. The print sorting portion of the Pako Photopacker is described in U.S. Pat. No. 4,114,349 by G. A. Jensen, L. A. Larson, and R. E. Diesch which is assigned to Pako Corporation. The Pako Photopacker includes a main conveyor line for good prints, and first and second branch conveyor lines for reject and remake prints. Diverters are positioned at the openings of the first and second branch conveyor lines for diverting reject and remake prints into the first and second branch conveyor lines, respectively. Positioned near the end of each of the conveyor lines of the Pako Photopacker is a print sensor formed by a light source and a light sensor. The control circuitry of the Pako Photopacker monitors the signals from the three print sensors to determine when the trailing edge of a print has passed the print sensor. The paper cutter used in conjunction with the Photopacker advances a length of photographic print paper past the knife of the paper cutter and stops the paper at a position in which the desired cut location is aligned with the knife assembly. The paper cutter then provides a signal to the Photopacker control circuitry indicating that the paper has been advanced and is at the cut position. When the Photopacker control circuitry receives a signal from one of the three print sensors indicating that the trailing edge of the previous print has just passed the print sensor, the Photopacker control circuitry then provides an enable signal to the paper cutter which permits the next print to be cut. The process is then repeated with the Photopacker control circuitry waiting for the print to reach its destination, while the paper cutter advances the paper, stops the paper at the cut position, provides a signal to the Photopacker indicating that the paper is stopped, and waits for the next cut enable signal from the Photopacker control circuitry. The purpose of this arrangement is to prevent jamming within the conveyor lines. If a print has not reached its destination, but rather is hung up within the conveyor lines, subsequent prints would cause further jamming to occur.

Although the print sensing arrangement of the Pako Photopacker avoids large jams of prints from occurring, and provides early warning to the operator of the existence of a possible jam, it does have disadvantages. The most important disadvantage is that it reduces the operating speed of the cutting and sorting apparatus. With the development of very high speed photographic paper cutters, the print sensor arrangement used in the Pako Photopacker prevents the paper cutter from operating at its full capacity. Rather, the paper cutter is forced to stop and wait until the print has reached its destination at the end of the conveyor lines.

There is a continuing need for improved photographic print cutting and sorting apparatus which provides protection against print jams, while permitting high speed operation of the photographic paper cutter.

SUMMARY OF THE INVENTION

The present invention is an improved photographic print cutting, sorting, and conveying apparatus in which individual photographic prints are cut from a continuous roll of processed photographic prints, sorted into good, remake, and reject prints, and conveyed along a main conveyor line and first and second branch conveyor lines. The apparatus of the present invention includes cutter means for cutting individual photographic prints from the continuous rolls. Indicia sensing means sense indicia on the prints indicative of remake and reject prints, and provide signals indicative of whether a print is a good, remake, or reject print. Cut prints from the cutter are directed along the main conveyor line, and may be diverted into the first and second branch conveyor lines by first and second diverting means.

Positioned proximate the discharge ends of the main conveyor line and the first and second branch conveyor lines is a print sensor means which provides a signal when a trailing edge of a print has passed the print sensor means. A signal from the print sensor means, therefore, indicates that a print has reached its destination at the discharge end of one of the conveyor lines.

Operation of the cutter means and the first and second diverting means is controlled by control means which receives signals from the indicia sensing means and the print sensor means. If the print being conveyed along the conveyor line is a remake or reject print, the control means will not enable the cutter means to cut another print until a signal is received from the print sensor means indicating that the remake or reject print has reached its destination. If, on the other hand, the print being conveyed is a good print, the control means permits another print to be cut prior to receiving a signal from the print sensor means.

DETAILED DESCRIPTION OF THE PREFERRED EMBODIMENTS

In one preferred embodiment, the present invention represents an improvement to a photographic print cutting, sorting, and conveying apparatus formed by the Pako PC305 print cutter and the Pako PS305 print sorter. The present invention, therefore, will be described in the context of these devices. It should be understood, however, that the present invention is equally applicable to other devices and systems.

Figure 1:
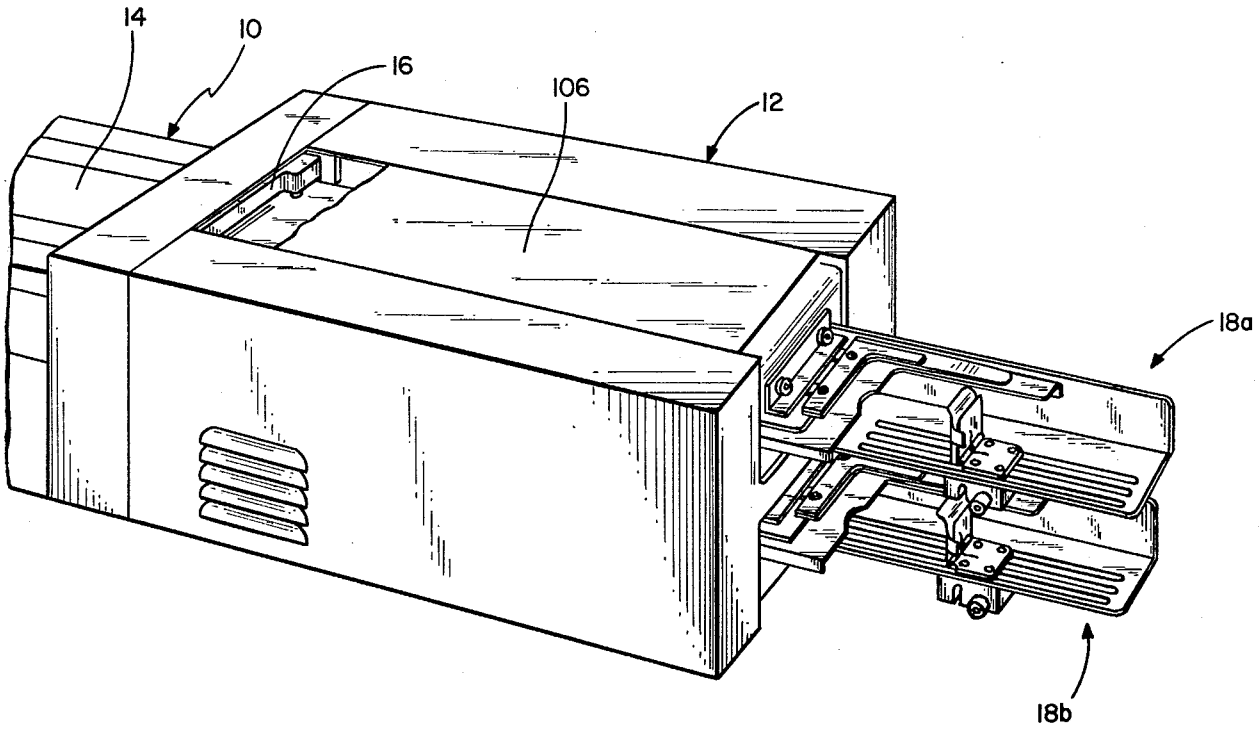
FIG. 1 is a perspective view of a photographic print cutting, sorting, and conveying apparatus utilizing the present invention.

FIG. 1 shows a photographic print cutting and sorting system which includes a photographic print cutter 10 and a print sorter 12. Photographic print cutter 10 is, in the preferred embodiment shown, an automatic photographic paper cutter such as the Pako PC305 paper cutter, which is generally described in the previously mentioned U.S. Pat. No. 4,128,887 by G. Strunc and F. Laciak. Print sorter 12 is, in the preferred embodiment shown, a Pako PS305 print sorter which is generally described in the previously mentioned patent application Ser. No. 21,091 by R. E. Diesch and C. L. Eutenuer.

Photographic prints are cut from strip 14 by knife assembly 16 of print cutter 10. The cut prints are sorted by print sorter 12 into good, remake, and reject prints. This sorting is done on the basis of remake and reject indicia which are applied to the face of remake and reject prints, respectively, by the operator of the cutter/sorter system. The indicia are sensed by remake/-reject sensor 15 (shown schematically in FIG. 3) which is located on print cutter 10 near knife assembly 16.

As shown in FIG. 1, print sorter 12 has two print stacking assemblies: good print stacker **18*a* and remake print stacker 18*b*. The "good" prints (which have neither a remake indicium nor a reject indicium) are conveyed by print sorter 12 to good print stacker assembly 18*a*. Remake prints are directed along a different path and conveyed by sorter 12 to remake print stacking assembly 18*b*. The reject prints are driven along still a third path and are either driven out the bottom of sorter 12** and into a wastebasket or the like, or driven and stacked on a third print stacking assembly (not shown).

At the end of each order the operator removes the good and remake prints accumulated at print stacking assemblies **18*a* and 18*b***, respectively, and places the prints into the customer order envelope. The system is then re-started and prints of the next order are sorted and stacked.

Figure 2:
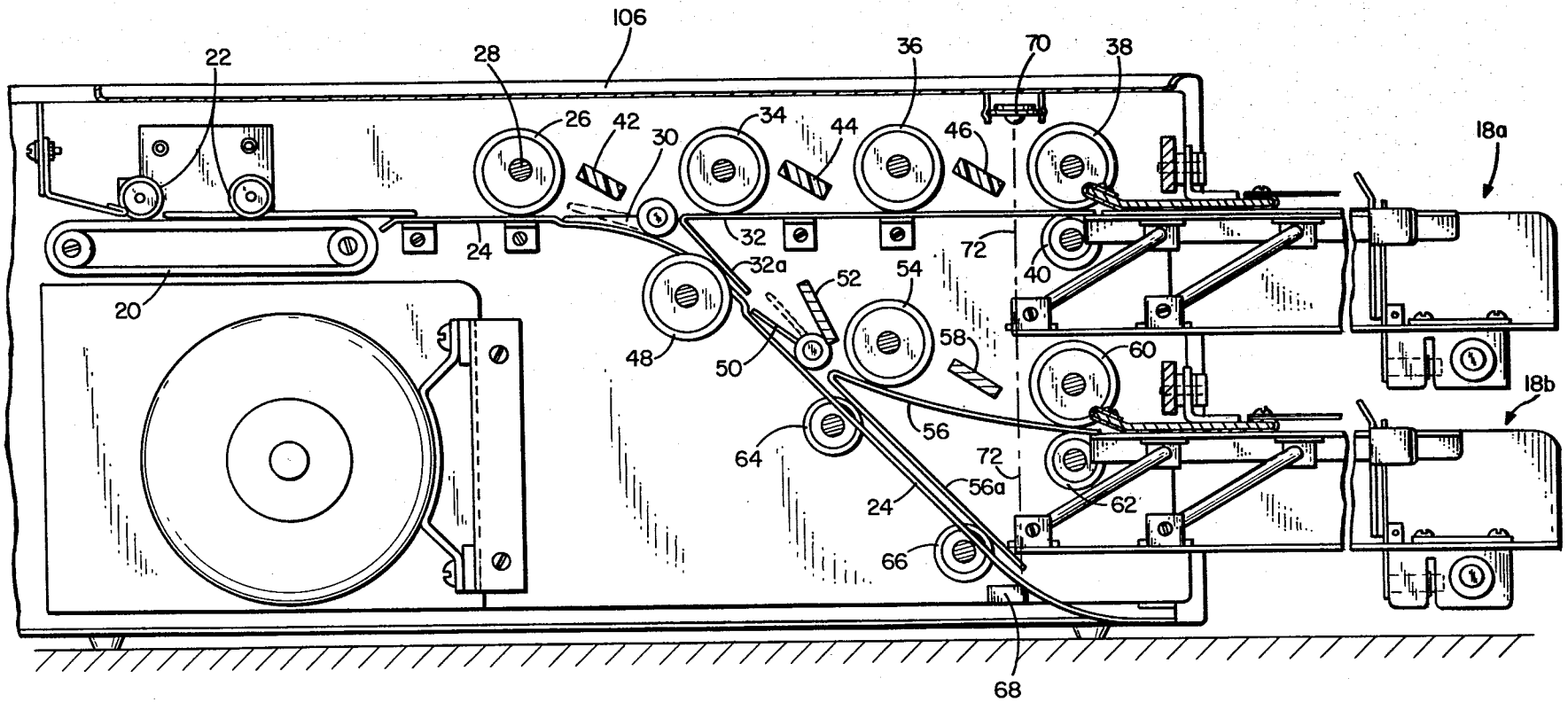
FIG. 2 is a side sectional view of the print sorting and conveying portion of the apparatus of FIG. 1.

FIG. 2 shows a sectional side view of the print sorter of FIG. 1. As will be noted from the following discussion, the print sorting and conveying portions of the print sorter are generally similar to the mechanism shown in the previously mentioned U.S. Pat. No. 4,114,349 by G. A. Jensen, L. A. Larson, and R. E. Diesch.

Photographic prints from print cutter 10 are fed onto a constantly moving conveyor which includes a plurality of O-ring type feed belts 20. The prints are held in contact with feed belts 20 by idler rollers 22.

Feed belts 20 are positioned immediately ahead of the entrance to the main conveyor line. Each print is first driven onto conveyor bed 24, where it is driven by a first set of drive rollers 26, which are driven on a common shaft 28.

Located immediately following drive rollers 26 is first movable deflector or diverter 30. When the print being conveyed is a "good print," first deflector 30 is in its downward position shown in solid lines in FIG. 2. In this position, first deflector 30 covers the opening to the branch lines for "remake" and "reject" prints and causes the print to be transported over the top surface of first deflector 30 to conveyor bed 32 and drive rollers 34. The print continues to be conveyed along the top surface of bed 32 by drive rollers 36 until it reaches the final set of drive rollers 38 at the discharge end of the good print conveyor line. Idler rollers 40 underly drive rollers 38 at the discharge end.

As shown in FIG. 2, stationary inclined deflectors 42, 44 and 46 are positioned along the main conveyor line between successive sets of drive rollers. The downstream edges of deflectors 42, 44 and 46 are more closely spaced to the conveyor bed (24 or 32) than are their upstream edges. If a print is curled or warped, inclined deflectors 42, 44 and 46 tend to force the print downwardly toward the conveyor bed and momentarily straighten the print, thus ensuring positive engagement of the front edge of the print with the next set of rollers. This prevents a curled or warped print from jamming the conveyor line by being driven over rather than under one of the sets of drive rollers.

If the print is a remake or reject print, first movable deflector 30 is pivoted to its upper position, as shown in phamtom in FIG. 2. In this position, first deflector 30 causes the print to be driven downward into the branch conveyor lines for remake and reject prints. The print is first engaged by down-turned portion 32*a* of conveyor bed 32 and is driven generally downward by a set of drive rollers 48.

Second movable deflector 50 is positioned to direct remake prints along one path and reject prints along another path. In FIG. 2, the position the movable deflector 50 shown in solid lines is for remake prints, while the position of movable deflector 50 shown in phantom is for reject prints.

Remake prints are driven across the top surface of deflector 50, and are deflected downward slightly by inclined stationary deflector 52 and between drive rollers 54 and conveyor bed 56. The print is then deflected by deflector 58 to drive rollers 60 and idler rollers 62 at the discharge end of the remake conveyor line.

When the print is a reject print, movable deflector 50 is pivoted to its upper position shown in phantom in FIG. 2. In this position, deflector 50 causes the reject print to travel down the reject conveyor line defined by conveyor bed 24 and the down-turned portion 56*a* of conveyor bed 56. The reject print is driven by drive rollers 64 and 66 to the bottom of the machine, where it is traveling with sufficient momentum to pass out of the machine and into a wastebasket or the like.

As shown in FIG. 2, print sorter 12 includes light source 68 and light sensor 70. Light source 68 is positioned below conveyor bed 24 near the discharge end of the reject print line. Light from light source 72 is directed upward along light path 72 to light sensor 70, which is positioned above conveyor bed 32 of the good print conveyor line. The light traveling along light path 72 passes through openings in the good, remake, and reject conveyor lines so that sensor 70 senses the presence of a print approaching the discharge end of any one of the three conveyor lines. Appropriate openings in conveyor beds 24, 32 and 56 and down turned portion 56*a* of conveyor bed 56 are provided to permit passage of light along light path 72 from light source 68 to sensor 70.

Figure 3:
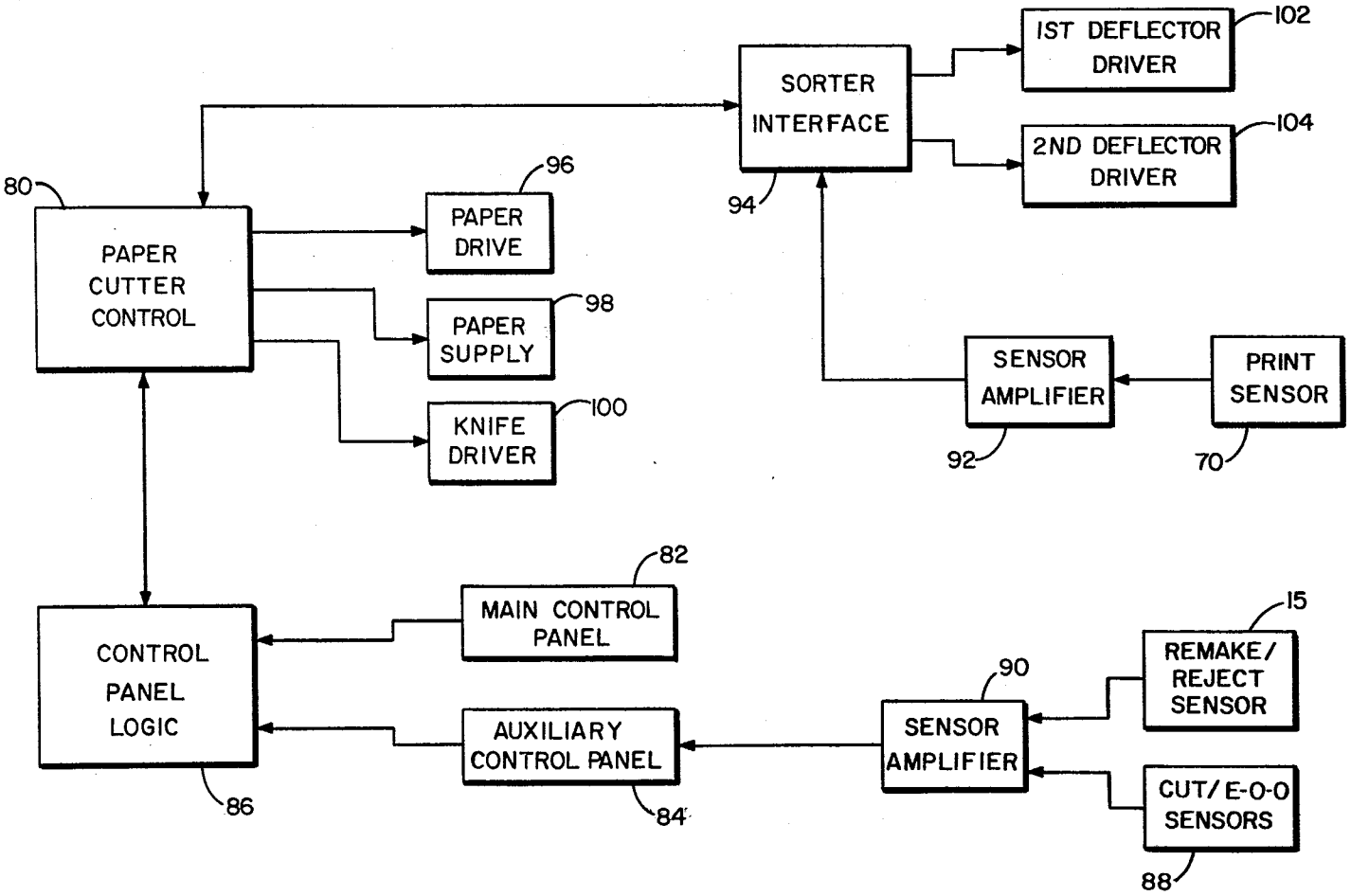
FIG. 3 is an electrical block diagram of the control circuitry for the photographic print cutting, sorting, and conveying apparatus of FIGS. 1 and 2.

FIG. 3 is an electrical block diagram of the control system for controlling the operation of paper cutter 10 and print sorter 12 in accordance with the present invention. The control system includes paper cutter control 80 which preferably includes a microcomputer and is housed within the paper cutter 10.

In the embodiment shown in FIG. 3, paper cutter control 80 receives inputs from various switches on main control panel 82 and auxiliary control panel 84 through control panel logic circuit 86. In addition, signals from remake/reject sensor 15 and cut/end-of-order sensors 88 are signal conditioned and amplified by sensor amplifier circuit 90 and supplied through auxiliary control panel 84 and control panel logic 86 to paper cutter control 80.

Input signals are also received by paper cutter control 80 from print sensor 70. The signals from print sensor 70 are amplified and signal conditioned by sensor amplifier 92 and supplied through sorter interface 94 to paper cutter control 80.

Paper cutter control 80 controls paper drive 96, paper supply 98, and knife driver 100 of the paper cutter. In addition, paper cutter control 80 supplies control signals through sorter interface 94 to first and second deflector drivers 102 and 104, respectively. Drivers 102 and 104 control the position of first and second deflectors 30 and 50, respectively (shown in FIG. 2).

In the present invention, paper cutter control 80 causes paper drive 96 to feed paper strip 14 (FIG. 1) past knife assembly 16. The length of paper advanced past knife assembly 16 is controlled by paper cutter control 80 as a function of stored information within paper cutter control 80, switch settings from main control panel 82 and/or auxiliary control panel 84, and signals from cut/end-of-order sensors 88.

When paper cutter control 80 actuates knife driver 100, knife assembly 16 cuts a print from paper strip 14. This print is then conveyed by print sorter 12 away from knife assembly 16 and through one of the three conveyor lines for good, remake, reject prints. Paper cutter control 80 determines the position of first and second deflectors 30 and 50 as a function of signals from remake/reject sensor 15 and supplies control signals to the appropriate drivers 102 and 104.

In the present invention, paper cutter control 80 monitors the signals from print sensor 70, which have been amplified and signal processed by sensor amplifier 92. The signal from sensor amplifier 92 indicates when the trailing edge of a print passes by light path 72, and thereby has reached its destination at the end of one of the three conveyor lines.

While a print is being conveyed through sorter 12, paper cutter control 80 actuates paper drive 96 to feed another length of the paper strip 14 past knife assembly 16. If the print being sorter is either a remake or a reject print, paper cutter control 80 will not actuate knife driver 100 and cut another print from strip 14 until the signal from print sensor 70 (and sensor amplifier 92) indicates that the remake or reject print has reached its destination. On the other hand, if the print being conveyed and sorted is a good print, paper cutter control 80 will enable knife driver 100 to cut another print prior to receipt of the signal from print sensor 70 (and sensor amplifier 92).

The present invention provides a significant increase in operating speed of cutter 10 and sorter 12, without seriously affecting the reliability of the cutter/sorter apparatus. Since most prints are classified as good prints, overall operating speed of the apparatus is significantly increased by permitting a second print to be within sorter 12 at the same time as long as the first print is a good print. In addition, in the preferred embodiment of the present invention shown in FIGS. 1 and 2, sorter 12 has a removable top cover 106 which, when removed, permits complete access to the main conveyor line for good prints. It is, therefore, very easy to clear a jam within the good print main conveyor line, while it is much more difficult to clear a jam in the remake/-reject branch conveyor lines.

In a preferred embodiment of the present invention, paper cutter control 80 will not permit more than a predetermined number of prints, such as two, to be within sorter 12 at any one time, even if the prints are good prints. As a result, the extent of any jamming within the good print line is minimal, even when it does occur, since very few prints are involved.

In conclusion, the present invention is an improved paper cutter and sorting apparatus which achieves high speed operation, while still providing print sensing to eliminate undetected print jams. The present invention requires a minimum of additional components, preferably a single light source 68, a single print sensor 70, and a sensor amplifier circuit 92 for processing the signals from the single print sensor 70.

Although the present invention has been described with reference to preferred embodiments, workers skilled in the art will recognize that changes may be made in form or detail without departing from the scope and spirit of the invention.

What is claimed is:

1. A photographic print cutting and sorting apparatus for cutting individual photographic prints from a continuous roll of processed photographic prints and sorting the prints into good, remake and reject prints, the apparatus comprising:

cutting means for cutting individual prints from a continuous roll of processed photographic prints;

a main conveyor line for receiving the individual prints cut by the cutter means, the main conveyor line having a good print discharge end at which good prints are discharged;

a first branch conveyor line having a remake print discharge end at which remake prints are discharged;

a second branch conveyor line having a reject print discharge end at which reject prints are discharged;

indicia sensing means for sensing indicia associated with the prints indicative of whether an individual print is a good, remake or reject print, the indicia sensing means providing signals as a function of the sensed indicia;

diverting means for diverting remake prints into the first branch conveyor line and diverting reject prints into the second branch conveyor line;

print sensor means for providing signals when a print has reached one of the discharge ends; and control means for controlling the cutter means and the diverting means as a function of signals from the indicia sensing means and the print sensor means; wherein if a print being conveyed is a remake or reject print, the control means prevents the cutter means from cutting another print until it receives a signal from the print sensor means indicating that the remake or reject print has reached the remake print or reject print discharge end; and wherein if a print being conveyed is a good print, the control means permits the cutter means to cut, prior to receiving a signal from the print sensor means indicating that the good print has reached the good print discharge end.

2. The apparatus of claim 1 wherein the print sensor means is positioned proximate the discharge ends of the main conveyor line and the first and second branch conveyor lines.

3. The apparatus of claim 2 wherein the print sensor means provides a signal when a trailing edge of a print has passed the print sensor means.

4. The apparatus of claim 2 wherein the first and second branch conveyor lines are positioned generally below the main conveyor line and wherein the good print discharge end is positioned generally above the remake and reject print discharge ends.

5. The apparatus of claim 4 wherein the print sensor means comprises a light source positioned proximate one of the discharge ends, and a light sensor positioned proximate one of the other discharge ends, the light source providing a light beam passing through the main conveyor line, the first branch conveyor line and the second branch conveyor line to the light sensor means, the path of the light beam being located proximate the good print discharge end, the remake print discharge end, and the reject print discharge end.

6. The apparatus of claim 5 and further comprising:

a housing for containing the main conveyor line and the branch conveyor lines, the housing having an opening positioned over the main conveyor line; and a removable cover for covering the opening in the housing positioned over the main conveyor line.

7. The apparatus of claim 1 wherein the control means prevents the cutter means from cutting another print until the control means has received a signal from the print sensor means indicating that a print has reached a discharge end, if a predetermined number of prints are being conveyed.

8. The apparatus of claim 7 wherein the predetermined number of prints is two.

9. A photographic print cutting and sorting apparatus for cutting individual photographic prints from a continuous roll of processed photographic prints and sorting the prints into good, remake and reject prints, the apparatus comprising:

cutter means for cutting individual prints from a continuous roll of processed photographic prints;

a main conveyor line for receiving the individual prints cut by the cutter means, the main conveyor line having a good print discharge end at which good prints are discharged;

a first branch conveyor line having a remake print discharge end at which remake prints are discharged;

a second branch conveyor line having a reject print discharge end at which reject prints are discharged;

indicia sensing means for sensing indicia associated with the prints indicative of whether an individual print is a good, remake or reject print, the indicia sensing means providing signals as a function of the sensed indicia;

diverting means for diverting remake prints into the first branch conveyor line and diverting reject prints into the second branch conveyor line;

print sensor means for providing signals when a print has reached one of the discharge ends; and control means for controlling the cutter means and the diverting means as a function of signals from the indicia sensing means and the print sensor means; wherein the control means prevents the cutter means from cutting, another print prior to arrival of a previously cut remake or reject print at the remake print or reject print discharge end, and permits the cutter means to cut another print prior to arrival of a previously cut good print, at the good print discharge end.

10. The apparatus of claim 9 wherein the print sensor means is positioned proximate the discharge ends of the main conveyor line and the first and second branch conveyor lines.

11. The apparatus of claim 10 wherein the print sensor means provides a signal when a trailing edge of a print has passed the print sensor means.

12. The apparatus of claim 10 wherein the first and second branch conveyor lines are positioned generally below the main conveyor line and wherein the good print discharge end is positioned generally above the remake and reject print discharge ends.

13. The apparatus of claim 12 wherein the print sensor means comprises a light source positioned proximate one of the discharge ends, and a light sensor positioned proximate one of the other discharge ends, the light source providing a light beam passing through the main conveyor line, the first branch conveyor line and the second branch conveyor line to the light sensor means, the path of the light beam being located proximate the good print discharge end, the remake print discharge end, and the reject print discharge end.

14. The apparatus of claim 13 and further comprising;

a housing for containing the main conveyor line and the branch conveyor lines, the housing having an opening positioned over the main conveyor line; and a removable cover for covering the opening in the housing positioned over the main conveyor line.

15. The apparatus of claim 9 wherein the control means prevent the cutter means from cutting another print prior to arrival of a previously cut good print at the good print discharge end if a predetermined number of good prints have been cut without arrival of the first of the good prints at the good print discharge end.

16. The apparatus of claim 15 wherein the predetermined number is two.

* * * * *